US005555680A

United States Patent [19]

Sweers

[11] Patent Number: 5,555,680

[45] Date of Patent: Sep. 17, 1996

[54] GUARD SCREEN FOR A RAIN GUTTER HAVING FLANGES FOR GRIPPING THE FRONT LIP OF A GUTTER

[76] Inventor: Ronald L. Sweers, 6165 E. Atherton Rd., Burton, Mich. 48519

[21] Appl. No.: 363,641

[22] Filed: Dec. 22, 1994

[51] Int. Cl.[6] ..... E04D 13/076

[52] U.S. Cl. ..... 52/12; 52/94; 210/474; 248/48.1

[58] Field of Search ..... 52/11, 12, 94, 52/95, 96; 248/48.1, 48.2; 210/474; D23/267

[56] References Cited

U.S. PATENT DOCUMENTS

| | | | |
|---|---|---|---|
| 2,290,741 | 7/1940 | Sullivan et al. | 210/474 |
| 2,935,954 | 5/1960 | Matthews et al. | 52/12 X |
| 3,053,393 | 9/1962 | McLean | 210/474 |
| 3,297,285 | 1/1967 | Simmons . | |
| 3,351,206 | 11/1967 | Wennerstrom | 210/474 |
| 3,420,378 | 1/1969 | Turner . | |
| 3,428,183 | 2/1969 | Bristow . | |
| 3,630,383 | 12/1971 | Reeves . | |
| 3,741,398 | 6/1973 | Abramson . | |
| 3,977,135 | 8/1976 | Hunley, Jr. . | |
| 4,036,761 | 7/1977 | Rankin . | |
| 4,271,643 | 6/1981 | Sweers . | |
| 4,286,418 | 9/1981 | Synder | 52/11 |
| 4,307,976 | 12/1981 | Butler . | |
| 4,406,093 | 9/1983 | Good et al. | 52/12 X |
| 4,445,301 | 5/1984 | Transki | 52/11 |
| 4,553,356 | 11/1985 | Pepper . | |
| 4,573,290 | 3/1986 | Fleming . | |
| 4,713,915 | 12/1987 | Sweers . | |
| 4,745,710 | 5/1988 | Davis | 52/12 |
| 4,765,101 | 8/1988 | Wolf | 52/12 |
| 4,941,299 | 7/1990 | Sweers . | |
| 4,965,969 | 10/1990 | Antenen | 52/12 |
| 5,181,350 | 1/1993 | Meckstroth | 52/12 |
| 5,398,464 | 3/1995 | Jacobs | 52/12 |

FOREIGN PATENT DOCUMENTS

| | | | |
|---|---|---|---|
| 734948 | 5/1966 | Canada | 52/12 |
| 2-304168 | 12/1990 | Japan | 52/11 |
| 2210648 | 6/1989 | United Kingdom | 52/11 |

*Primary Examiner*—Carl D. Friedman
*Assistant Examiner*—Laura A. Saladino
*Attorney, Agent, or Firm*—Gifford, Krass, Groh, Sprinkle, Patmore, Anderson & Citkowski, P.C.

[57] ABSTRACT

A guard screen for a rain gutter for placement over the open end of a rain gutter for preventing the accumulation of debris in the gutter. The guard screen of the present invention includes a longitudinal screen body bordered by a pair of longitudinal edges. The guard screen includes a first edge and a second edge. The first edge has a U-shaped channel defined therein for connection with the front lip of a conventional gutter. At the terminal ends of the arms of the "U" are provided opposing flanges that reduce the open end of the channel to a narrow slot. The lip of the gutter is gripped between the opposing flanges when the guard screen is in place and, when in position, the lip of the gutter is firmly held therein. The second edge includes a flange for placement between the shingles of a roof and the roof boards. The screen body is preferably composed of a polymerized material.

15 Claims, 1 Drawing Sheet

GUARD SCREEN FOR A RAIN GUTTER HAVING FLANGES FOR GRIPPING THE FRONT LIP OF A GUTTER

BACKGROUND OF THE INVENTION

I. Field of the Invention

The present invention relates generally to guard screens for rain gutters. More particularly, the present invention relates to a guard screen for a rain gutter having a first end with opposing flanges for gripping the front lip of a gutter and a second end for fitting between a roof board and the shingles of a roof.

II. Description of the Relevant Art

Guard screens for gutters are known and are directed to preventing leaves and similar debris from entering the open end of a gutter. When such a debris accumulates in a gutter, the passage of water therein is impeded.

Most known gutter screens are composed of a metal. For example, U.S. Pat. No. 3,297,285 issued on Jan. 10, 1967 to Simmons discloses a gutter screen attachment that includes a flat screen that is placed over the open end of the gutter. The screen is held to the gutter by a series of clips.

U.S. Pat. No. 3,428,183 issued on Feb. 18, 1969 to Bristow discloses a screen adapted for placement on the open end of a gutter. Fitted to the underside of the screen is a sinusoidal-like element that attaches to the underside of the gutter lip for holding the screen in place.

Disclosing another clip system is U.S. Pat. No. 3,630,383 issued on Dec. 28, 1971 to Reeves. The gutter screen assembly of this reference includes a flat metal screen for placement over a gutter and clips to hold the metal screen in place. The metal screen includes an edge having a series of holes defined therein. The clips of the assembly are placed through the holes for attachment to the lip of the gutter.

Another screen of the metal type is disclosed in U.S. Pat. No. 4,036,761 issued on Jul. 19, 1977 and issued to Rankin. According to this patent, a metal screen is provided for placement over the open end of a gutter. The edge of the screen furthest away from the roof board is attached to the lip of the gutter by a U-shaped clip.

While having some advantages in that it is relatively inexpensive and is more or less flexible, metal screens have proven, for the most part, to be impractical. Because they are bendable and not resilient, they are easily damaged and quickly become unpleasant to look at. Furthermore, they are not easily attached to the gutter, and typically require metal clips or fasteners or a similarly complex system of attachment. Finally, metal screens are relatively difficult to produce.

In an effort to overcome the known disadvantages of metal screens, some plastic screens have been developed. For example, U.S. Pat. No. 4,553,356, issued on Nov. 19, 1985 to Pepper discloses a rainwater gutter system composed of plastic. According to this invention, a plastic extruded screen is provided for attachment to a plastic extruded gutter. The screen is fastened to the gutter by way of channels defined on the opposing sides of the open end of the gutter.

While the '356 patent to Pepper overcomes the problems of metal screens, the screen of the system has no utility independent of the system as a whole. While the system may be practical for fitting to a new house where there are no existing gutters, the Pepper system cannot be used to provide a screen over existing, non-extruded gutters.

In my previous U.S. Pat. No. 4,941,299 issued on Jul. 17, 1990, I disclosed a guard screen that was composed of a polymerized material. The guard screen of that invention included a channel for attachment to the lip of a gutter. However, according to this design, the guard was held in place by the screen being arched so as to provide a tension between the gutter lip and the roof.

Accordingly, the known methods for screening debris for existing gutters have generally failed to provide a system that is practical and convenient to install without the need for clips or tension to hold it in place.

SUMMARY OF THE PRESENT INVENTION

The present invention overcomes the failings of known methods of screening debris from gutters by providing an extruded screen composed of a polymerized material that may be effectively secured to an existing gutter without the necessity of fastening clips.

The gutter screen of the present invention includes a longitudinal screen body bordered by a pair of longitudinal edges, these edges being a first edge and a second edge. The first edge has a U-shaped channel defined therein for connection with the front lip of a conventional gutter. At the terminal ends of the arms of the "U" are provided opposing flanges. The flanges reduce the open end of the channel to a narrow slot such that, when in position, the lip of the gutter is firmly held therein. The second edge includes a flange for placement between the shingles of a roof and the roof boards. Disposed between the first and second edges is a screen body having a plurality of apertures defined therein. The apertures are large enough to permit the passing of rainwater but are small enough to prohibit the passage therethrough of debris.

The screen body is preferably composed of a polymerized material such as vinyl. Alternatively, the screen body may be composed of a rust-resistant metal such as aluminum. The plastic composition is preferred, however, to assure both ease of manufacture (through extrusion) and rust resistance.

Placement of the gutter screen over the open end of the gutter is accomplished by first sliding the flange of the second edge between the shingles and the roof boards. The channel of the first edge is then forced to interconnect with the front lip of the gutter. As noted, the narrow opening provided by the slight gap between the opposing flanges securely holds the screen to the gutter lip.

The guard screen according to the present invention may be applied to either the standard "K-style" gutter or to hemispherically-shaped gutters.

Other advantages and features of the present invention will become apparent from the following detailed description when read in conjunction with the accompanying drawings.

BRIEF DESCRIPTION OF THE DRAWINGS

The present invention will become more fully understood by reference to the following detailed description of the preferred embodiments of the present invention when read in conjunction with the accompanying drawings, in which like reference characters refer to like parts throughout the views, and in which.

DETAILED DESCRIPTION OF THE PREFERRED EMBODIMENTS OF THE PRESENT INVENTION

The drawings disclose the preferred embodiments of the present invention. While the configurations according to the illustrated embodiments are preferred, it is envisioned that alternate configurations of the present invention may be adopted without deviating from the invention as portrayed. The preferred embodiments are discussed hereafter.

Figure 1:
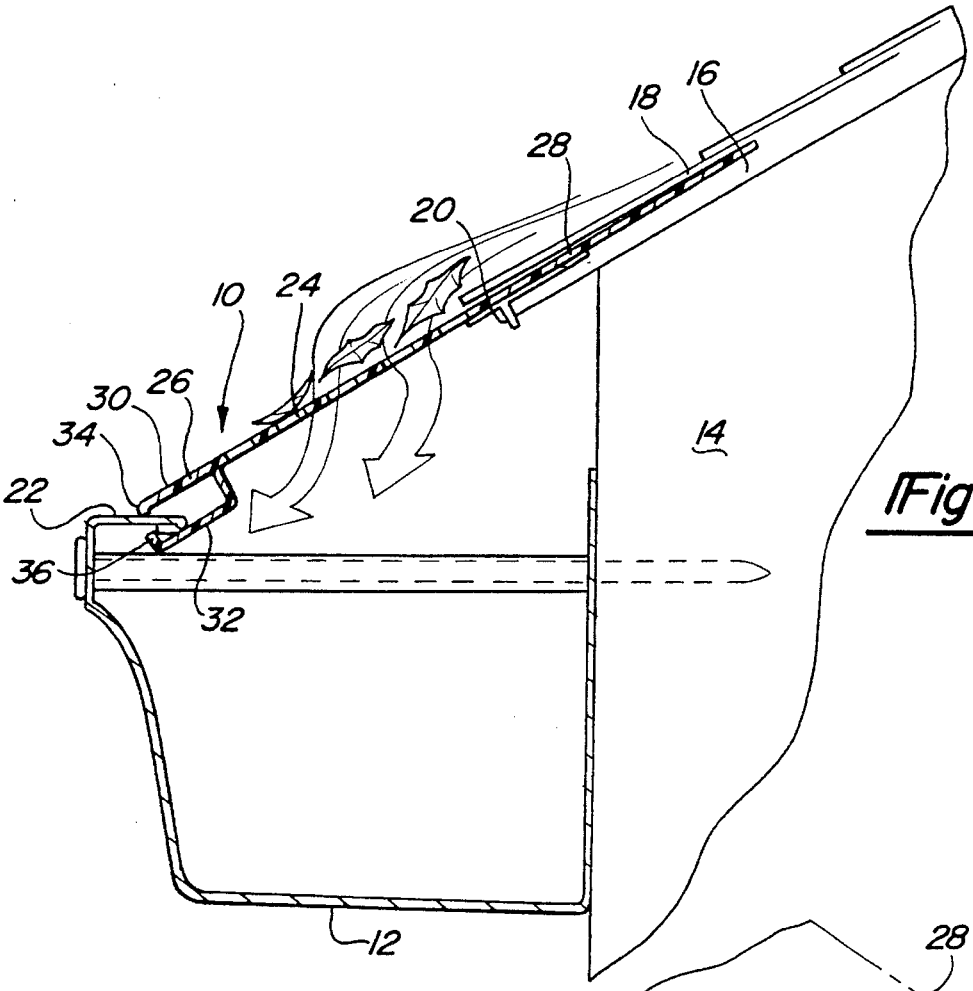
FIG. 1 is a cross-sectional view of a guard screen for a gutter according to the present invention in place on a gutter.

Referring first to FIG. 1, there is shown a guard screen for a gutter according to the present invention, generally indicated as 10, in place over a gutter 12. The gutter 12 as shown is of the conventional "K-style" design, although the guard screen according to the present invention may be fitted to a hemispherically-shaped gutter (not shown) as well.

The gutter 12 is attached to a fascia board 14 of a building's eave. Atop the facia board 14 is provided one or more roof boards 16 which have overlying thereover a plurality of roof shingles 18. At the front edge of the board 16 is conventionally provided a drip edge or gutter edge 20. The drip edge or gutter edge 20 is composed normally of vinyl, and is fitted to the edge of the boards 16 before the shingles 18 are applied to protect the underlying wood and to prevent curling or sagging of the shingles 18. The gutter 12, the fascia board 14, the roof board 16, the drip edge or gutter edge 20 and the shingles 18 present a construction which is conventionally known.

Also conventional is the fact that the gutter 12 also includes a front lip 22. The front lip 22 is cantilevered and extends inwardly from the outermost edge of the gutter 12. Most conventional gutter screens (not shown) include clips (not shown) that snap to the lip to hold the screen in place.

The guard screen 10 includes a screen body 24, a first longitudinal edge 26 that forms a "U" -shaped channel for attachment to the front lip 22 and a second longitudinal edge 28 for placement between the shingles 18 and the roof boards 16. The component parts 24, 26, 28 of the guard screen 10 form a single, extruded screen.

The screen body 24 (more clearly seen in FIGS. 2 and 3) is of such construction that water may bypass while debris is caught and kept out of the gutter.

As noted, the first longitudinal edge 26 defines a "U" -shaped channel. The channel includes an upper arm 30 and a lower arm 32. The upper arm 30 extends outwardly from the screen body 24 and terminates at a downturned flange 34. Conversely, the lower arm 32 extends outwardly from the screen body 24 and terminates at an upward flange 36.

The flanges 34, 36 are positioned such that they opposedly face one another, as illustrated. It is this opposed design that narrows the width of the open end of the "U" -shaped channel to a gap that is somewhat less than the width of the lip 22. With the preferred embodiment being polymerized and therefore resilient, the flanges 34, 36 tend to resist movement that separates them. This construction and composition assures that the first edge 26 is snugly mated to the lip 22. This snug grip is further assured as the second edge 28 of the screen 10 is pivoted upward away from the gutter in its disposition between the roof boards and the shingles. As illustrated, this placement serves to increase tension on the flanges 34, 36, thus further securing the screen 10 in its position.

Figure 2:
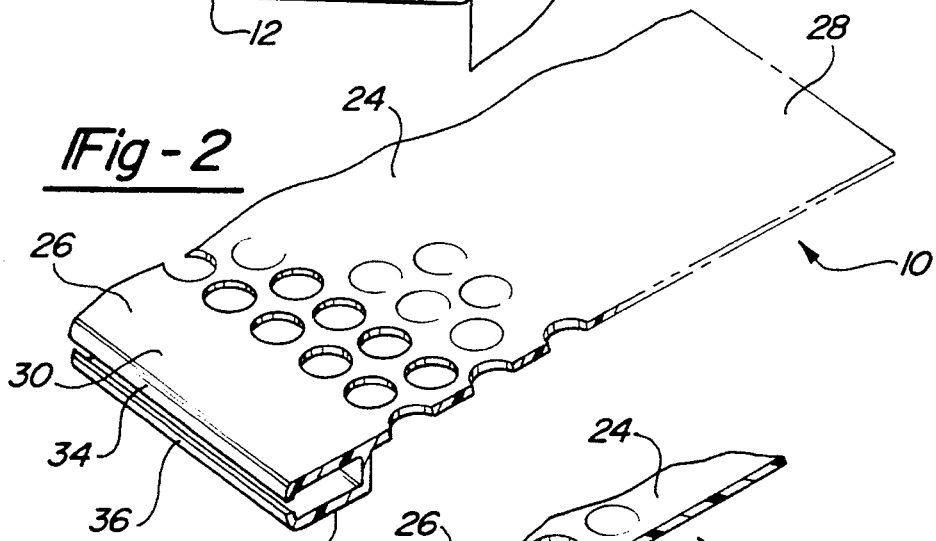
FIG. 2 is a perspective view of a partial section of the preferred embodiment of the present invention.

Referring to FIG. 2, a partial perspective view of the guard screen 10 according to the present invention is illustrated. This view illustrates the body 24, the first edge 26, and the second edge 28 of the screen 10. As may be clearly seen, only the lower arm 32 extends from the body 24 such that the top side of the guard screen 10 is planar. This construction, combined with the degree of inclination of the screen as installed minimizes the likelihood that debris will remain on the top side of the screen 10.

Figure 3:
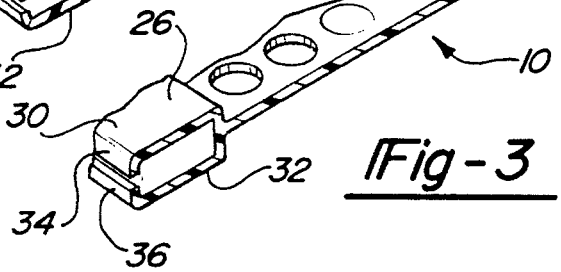
FIG. 3 is a perspective view of a partial section of the alternate embodiment of the present invention.

Referring to FIG. 3, a partial perspective view of the guard screen 10 according to the alternate embodiment is illustrated. This view illustrates only the body 24 and the first edge 26 of the screen. However, as is apparent, both the upper arm 30 and the lower arm 32 extend outwardly from the body 24 such that the guard 10 would always be right side up regardless of which side of the guard 10 faces upward. This provides for ease of installation and eliminates the risk of inverting the screen 10.

To place the guard screen 10 in its intended position, the second edge 28 is inserted between the roof boards 16 and the shingles 18. The insertion of the edge 28 is initially deeper than necessary. Thereafter, the first edge 26 is pulled downward toward the lip 22 until the flanges 34, 36 are positioned on either side of the lip 22. The first edge 26 is forced downward in this manner as far as it will proceed until the edge of the lip 22 presses against the inside of the lower arm 32, as illustrated in FIG. 1. No other fastening method is required.

In addition to the advantageous method of fastenerless attachment as described, the edge 28, being positioned below the shingles 18 as discussed, prevents water from traveling, by means of capillary action, along the roof board 16 and the fascia 14 to bypass the gutter 12 by passing therebehind. By the edge 28 more accurately directing the water into the gutter 12, contact of water with rot-susceptible wood is prevented.

Having described my invention, however, many modifications thereto will become apparent to those skilled in the art to which it pertains without deviation from the spirit of the invention as defined by the scope of the appended claims.

I claim:

1. In combination with roof boards of a roof having shingles laid thereover and a longitudinally extending rain gutter having a front lip, the front lip having an upper surface and a downwardly extending edge, comprising:

an elongated screen body;

an upper arm interconnected with said screen body extending longitudinally of said screen body, said upper arm including a terminal end;

an upper arm flange extending downwardly from said terminal end of said upper arm;

a lower arm interconnected with said screen body extending longitudinally of said screen body, said lower arm including a terminal end;

a lower arm flange extending upwardly from said terminal end of said lower arm, said upper arm flange and said lower arm flange extending toward each other;

said upper arm and said lower arm defining a channel;

an elongated flanged member interconnected with said screen body and extending longitudinally of said screen body, said flanged member including a flange;

said channel being interconnectable with said lip of said gutter;

said lower arm in engagement with said downwardly extending edge of said front lip of said rain gutter;

said flange being disposable between said shingles and said roof boards; and said screen body extending there between.

2. The guard screen according to claim 1 wherein said screen body is composed of vinyl.

3. The guard screen according to claim 1 wherein said screen body is composed of a polymerized material.

4. The guard screen according to claim 1 wherein said upper arm has a top side and said elongated screen body has a top side, said top side of said upper arm and said top side of said elongated screen body being planar.

5. The guard screen according to claim 1 wherein said upper arm and said lower arm are substantially parallel.

6. The guard screen according to claim 5 wherein said guard screen is composed of material selected such that said upper arm and said lower arm resist movement away from one another, whereby said lip is frictionally engaged between said upper arm flange and said lower arm flange.

7. The guard screen according to claim 1 wherein said lower arm has an upper side, said edge of said front lip abutting said upper side of said lower arm while said gutter screen is in place above said gutter.

8. In combination with roof boards of a roof having shingles laid thereover and a longitudinally extending rain gutter having a front lip, the front lip having an upper surface and a downwardly extending edge, a guard screen interconnecting said boards and said gutter, said screen comprising:

an elongated screen body;

an upper arm interconnected with said screen body extending longitudinally of said screen body, said upper arm including a terminal end;

an upper arm flange extending downwardly from said terminal end of said upper arm;

a lower arm interconnected with said screen body extending longitudinally of said screen body, said lower arm including a terminal end;

a lower arm flange extending upwardly from said terminal end of said lower arm, said upper arm flange and said lower arm flange extending toward each other;

said upper arm and said lower arm defining a channel;

said channel being interconnectable with said lip of said gutter said lower arm in engagement of said downwardly extending edge of said front lip of said rain gutter.

9. The guard screen according to claim 8 further including an elongated flanged member interconnected with said screen body and extending longitudinally of said screen body, said flanged member including a flange, said flange being disposable between said shingles and said roof boards.

10. The guard screen according to claim 8 wherein said upper arm flange and said lower arm flange are coplanar.

11. The guard screen according to claim 8 wherein said screen body is composed of a polymerized material.

12. The guard screen according to claim 8 wherein said upper arm has a top side and said elongated screen body has a top side, said top side of said upper arm and said top side of said elongated screen body being planar.

13. The guard screen according to claim 8 wherein said upper arm and said lower arm are substantially parallel.

14. The guard screen according to claim 13 wherein said guard screen is composed of a material selected such that said upper arm and said lower arm resist movement away from one another, whereby said lip is frictionally engaged between said upper arm flange and said lower arm flange.

15. The guard screen according to claim 8 wherein said lower arm has an upper side, said edge of said front lip abutting said upper side of said lower arm while said gutter screen is in place above said gutter.

* * * * *

UNITED STATES PATENT AND TRADEMARK OFFICE

CERTIFICATE OF CORRECTION

PATENT NO. : 5,555,680
DATED : September 17, 1996
INVENTOR(S) : Ronald L. Sweers It is certified that error appears in the above-indentified patent and that said Letters Patent is hereby corrected as shown below:

Column 4, line 45, after "edge", insert --a guard screen interconnecting said boards and said gutter, said screen--.

Column 6, line 7, after "gutter" insert --;--.

Signed and Sealed this
Sixth Day of May, 1997

Bruce Lehman

*Attest:*

*Attesting Officer*

BRUCE LEHMAN

*Commissioner of Patents and Trademarks*